United States Patent [19]

Ueng

[11] 4,342,327

[45] Aug. 3, 1982

[54] TAPE STRUT AND TAPE STRUT TENT

[76] Inventor: Ming-Shean Ueng, 3410 Hayes St., Hollywood, Fla. 33021

[21] Appl. No.: 86,051

[22] Filed: Oct. 18, 1979

[51] Int. Cl.[3] ..... A45F 1/00

[52] U.S. Cl. ..... 135/1 R; 135/16; 135/DIG. 10

[58] Field of Search ..... 135/1 R, 3 R, 4 R, 5 R, 135/7.1 R, 33 R, 33 C, 65, 20, DIG. 10, 16

[56] References Cited

U.S. PATENT DOCUMENTS

| | | | |
|---|---|---|---|
| 1,079,757 | 11/1913 | Gould | 135/4 R |
| 1,608,242 | 11/1926 | Sara | 135/4 R |
| 2,953,145 | 9/1960 | Moss et al. | 135/4 R |
| 3,453,786 | 7/1969 | Rebarchek | 135/3 R X |
| 3,474,802 | 10/1969 | Loring | 135/4 R X |
| 3,899,853 | 8/1975 | Wertman | 135/1 R X |
| 3,925,943 | 12/1975 | Petrie | 135/3 R X |

*Primary Examiner*—J. Karl Bell

[57] ABSTRACT

A tape strut comprising at least a tape and at least a zipper, means of combination of the tape and the zipper, means of attaching the tape on the zipper while in use and means of storage of the tape and the zipper while not in use. The zipper forms a closed loop around the tape in cross section while in use so that the tape strut can be used as a structure tubing to take load. The use of a tape strut as a structure tubing to take load in other products. The use of at least a tape strut as a structure tubing to take load in a tent and means of attaching of the tape strut onto the tent.

21 Claims, 11 Drawing Figures

FIG. 1
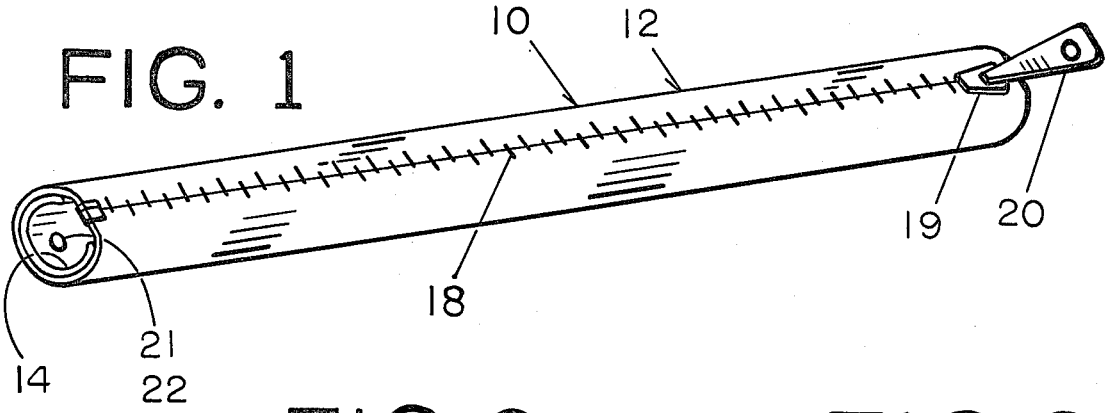
FIG. 2
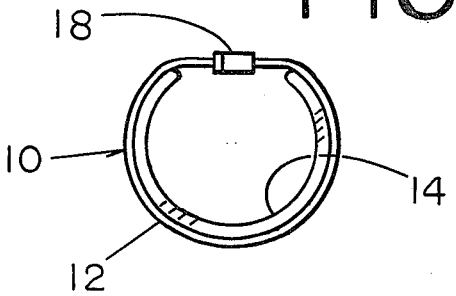
FIG. 3
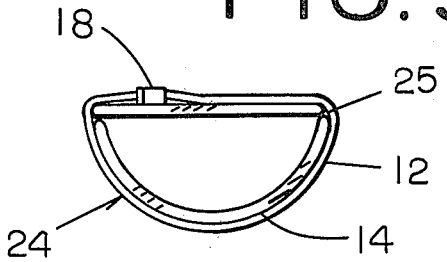
FIG. 4
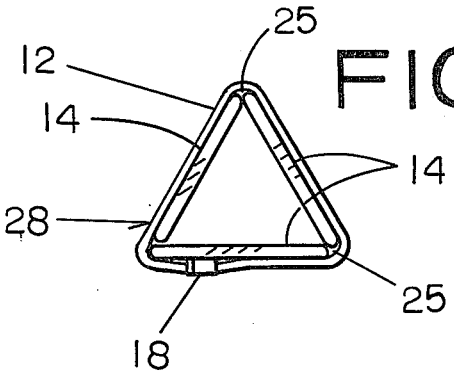
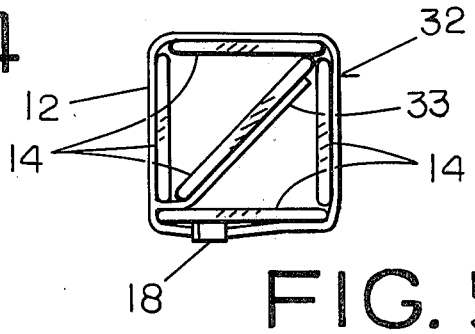
FIG. 5
FIG. 6
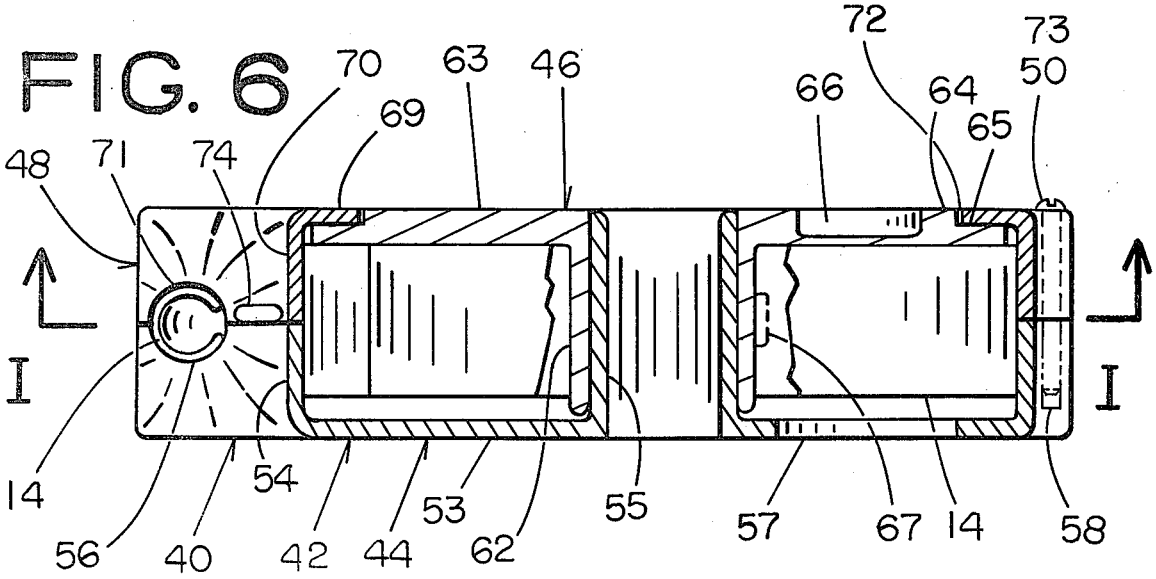

TAPE STRUT AND TAPE STRUT TENT

BACKGROUND OF THE INVENTION

The existing rigid tubings and U-channels are widely used as structure members to withstand load. But they are not foldable without a linkage relationship to convert into a shorter length for storage purpose. Even a set of end-to-end connected members is not compact in storage and not simple in manufacturing.

While a rollable tape after un-roll, can not take any load as a structure tubing.

Now, a tape strut of this invention is able to combine both advantages of a rigid structure tubing and a rollable tape. The tape strut consists of at least a tape and at least a zipper.

Before use, the tape is rolled on a roller to save space. To form a tape strut, un-roll the tape and meanwhile, enclose the un-rolled portion of the tape by closing the fasteners on the zipper, so that the tape and the zipper form a closed loop in cross section with the tape in a closed loop or an open channel in cross section ready to withstand load.

By a combination of varying width of tape, varying width of zipper, spring effect of tape, pre-deformation of tape, lamination of tapes and a series of holes on the tape, the tape strut can be a straight member or a curved member while in use.

After use, open the zipper and roll the tape back. Since the zipper is also flexible, it is easy to roll both the tape and the zipper in small package if required, so that they are easy to carry along and ready for use. Actually, before use the tape itself may be in a rolled coil so that no storage collar is necessary.

To form a tape strut, it is easier to use a tape assembly which has a channel forming tubing of varying depth, width and radius to allow the tape of flatten or slightly curved in cross section to pass through so that the shape of the cross section of the tape can be changed gradually and continuously.

The use of the tape strut of this invention in applicable products will make the packaging more compact to carry along.

A tent of any possible shape using the properties of the tape strut to withstand load will be able to make an outwardly tensed canopy. And it is compact in storage to carry along.

DESCRIPTION OF THE DRAWING

The objects, characteristics and advantages of this invention will be more fully understood from the accompanying drawings, in which:

FIG. 1 is an oblique view of the first preferred embodiment of the tape strut,

FIG. 2 is a front end view of FIG. 1,

FIG. 3 is a front end view of the second preferred embodiment,

FIG. 4 is a front end view of the third preferred embodiment,

FIG. 5 is a front end view of the fourth preferred embodiment of the tape strut of this invention, FIG. 6 is a front view of a tape strut assembly with the tape stored in a casing of partial section view.

DESCRIPTION OF THE INVENTION

Figure 5A:
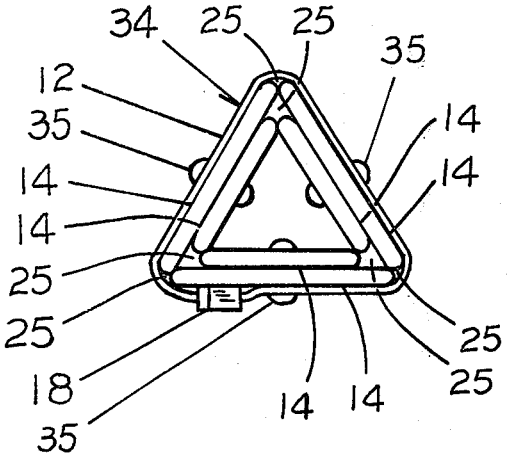
FIG. 5A is a front end view of the fifth preferred embodiment.

Now, referring to FIG. 1 there is shown a tape unit strut 10 having a zipper 12 and a tape 14. The zipper 12 has a plurality of fasteners 18, a slide 19 and a puller 20. The zipper 12 may have a larger width by attaching zipper halves onto a strip of required width. On each end of tape strut 10, there is a male snap fastener 21 and a female snap fastener 22 attaching on zipper 12 and tape 14, respectively. The tape 14 and zipper 12 may be separated or combined together while not in use. The use of riveting or glue is one of the methods to combine zipper 12 and tape 14.

In FIG. 2, a larger end view is shown for the first preferred embodiment of tape strut 10. The tape strut 10 has a zipper 12 of closed loop by fasteners 18, which enclosing tape 14 of deformed open channel. The male and female snap fasteners 21 and 22 are not shown for clarity. The shape in cross section of tape 14 may be deformed or spring back while in use due to the spring effect of tape 14. To control the shape of cross section of tape 14, holes may be added to allow tape 14 to be bent more easily.

In FIG. 3, there is the second preferred embodiment 24 of two pieces of tape 14 in series in cross section with zipper 12 having fasteners 18 enclosed outside. The tapes 14 are attached onto zipper 12 having a gap 25 between two tapes 14 before the close of zipper fasteners 18. The attaching method should allow zipper 12 free to slide open or close.

In FIG. 4, there is the third preferred embodiment 28 having three pieces of tape 14 attached onto zipper 12 with gaps 25 between tapes 14.

In FIG. 5, there is the fourth preferred embodiment 32 having five pieces of tape 14 attached onto zipper 12 with a sub-strip 33. One of tapes 14 forms the diagonal of the tape strut. In FIG. 5A, there is the fifth preferred embodiment 34 which is similar to FIG. 4, except that each side has double layers of tapes 14 riveted together by rivet 35.

Figure 5B:
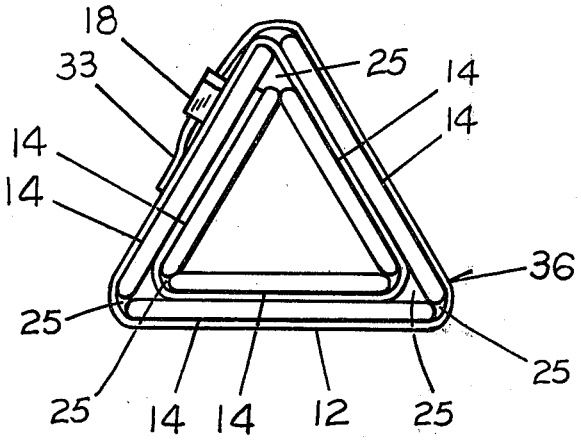
FIG. 5B is a front end view of the sixth preferred embodiment.

In FIG. 5B, there is the sixth preferred embodiment 36 which is similar to FIG. 4, except that there are two turns formed by a series of tapes 14. One of three sides has a sub-strip 33 attached so that it is possible to complete a closed loop.

Figure 5C:
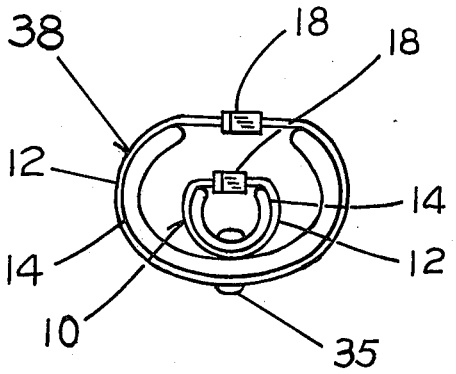
FIG. 5C is a front end view of the seventh preferred embodiment.

In FIG. 5C, there is a seventh preferred embodiment 38 which is similar to FIG. 2, except that an additional smaller tape strut 10 as shown in FIG. 2 is added at inside, so that the stiffness of tape strut 38 can be adjusted. The two different sizes of tape struts 10 are combined together by rivet 35.

All of the preferred embodiments described above, may have multiple layers of more than one in cross section, or multiple turns of overlap of more than one in cross section, or required gaps, or deformation or pre-deformation of the shape in cross section to allow the entire tape strut to bend, varying width in tape or in zipper, proper attaching method to allow the zipper to slide freely to open or close and side edges of tape round-off.

In FIG. 6, there is a tape assembly 40 having a tape 14 and a casing 42. Of course, it may be a combination of tapes and zippers, and the casing with the tapes and zippers rolled in coil or coils or in separated coils. The casing consists of a lower half 44, a roller 46, an upper half 48 and a plurality of screws 50.

The lower half 44 has a disk 53 with a vertical wall 54 on the outer ring, a tube 55 used as a rotating axle at the middle, a tube half 56 of varying depth, width and radius to change the shape of tape 14 gradually and continuously, a plurality of slots 57 and a plurality of threaded holes 58.

The roller 46 has a collar 62 which is mounted free to rotate on tube 55, a disk 63 with a vertical outer ring 64 and a guard 65 of horizontal outer ring, a plurality of holes 66 as a provision for a finger to put in to rotate the roller 46, and a snap fastener 67 for snap fastener 21 or 22 on the end of tape 14 to attach.

The upper half 48 has a disk 69 with a vertical wall 70 on the outer ring, a tube half 71 of varying depth, width and radius of the image of tube half 56 on lower half 44, a large hole 72 at the middle to confine the rotation of roller 46, a plurality of holes 73 corresponding to threaded holes 58, and a hook 74 used as a provision to pull and close puller 20 and fasteners 18 on zipper 12.

Figure 7:
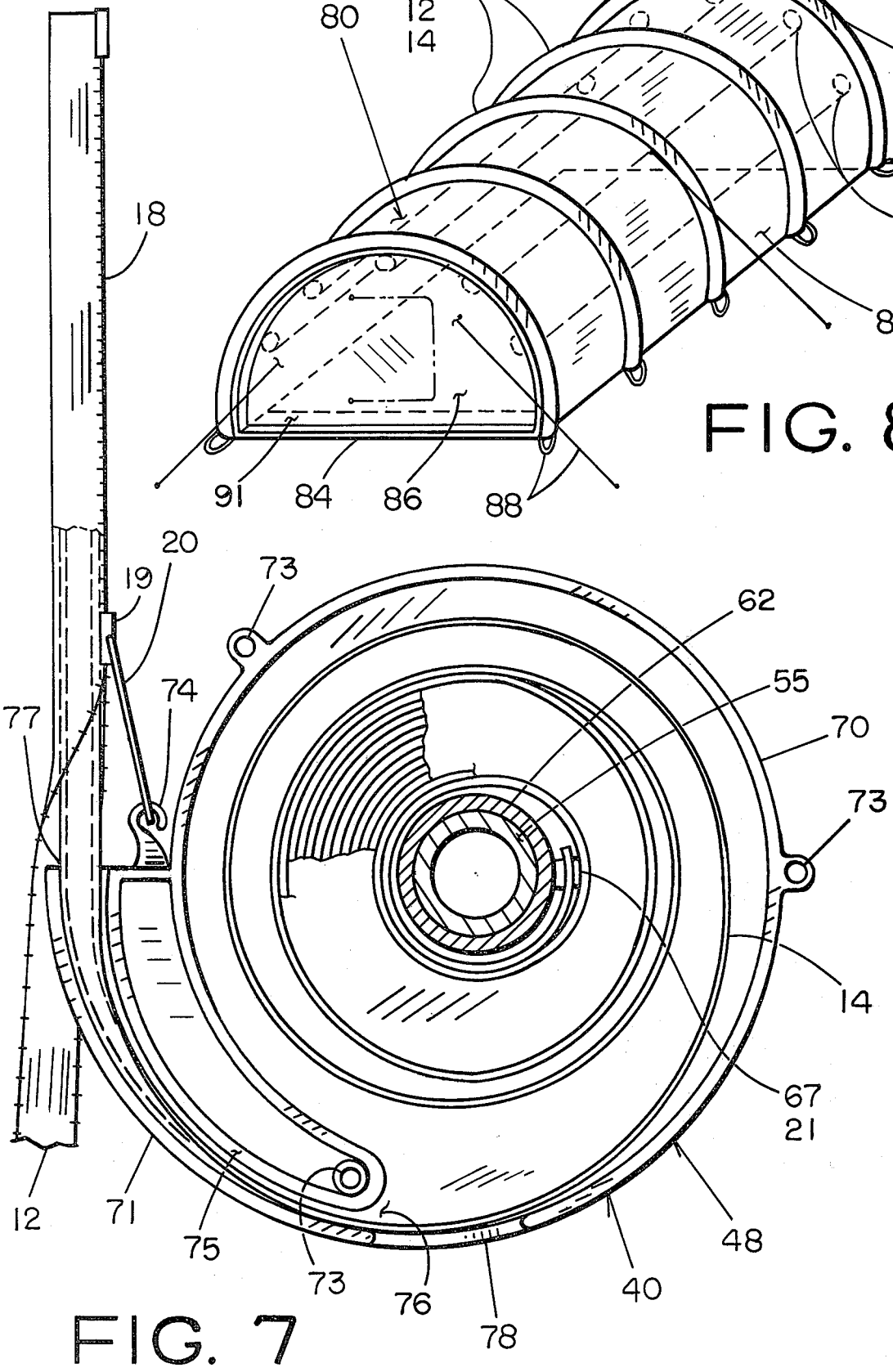
FIG. 7 is a cross sectional view taken along line I—I in FIG. 6.

In FIG. 7, a sectional view of the interior of tape assembly 40 is shown. The collar 62 will rotate around tube 55. The tape 14 has one of its end attached to a snap fastener 67 on collar 62. The vertical wall 70 confines the coils of tape 14. A guide 75 is a wall of varying shape in cross section helping the change of the shape of tape 14. The tube half 56 and tube half 71 convert tape 14, gradually and continuously, into the shape required through an opening 76 and a hole 77.

The hook 74 retain puller 20 to close fasteners 18 by pulling slide 19 on zipper 12 while the entire tape assembly 40 is moving downward and tape 14 coming out continuously by the unwinding of tape 14 about tube 55. The holes 73 are provided to assemble the parts.

The number of tape 14 may be more than one with tapes 14 in an end-to-end connection within a tape assembly 40. It is convenient to connect the overlapping ends of tapes by snap fasteners or by a combination of slot and push-out.

An opening 78 is formed by notches on vertical wall 54 of lower half 44 and vertical wall 70 of upper half 48. To roll tape 14 back into the assembly 40, instead of passing through hole 77, the tape 14 may pass directly through opening 78 by first, attach snap fastener 21 or 22 onto snap fastener 67 on collar 62 by the help of the fingers through slot 57.

Figure 8:
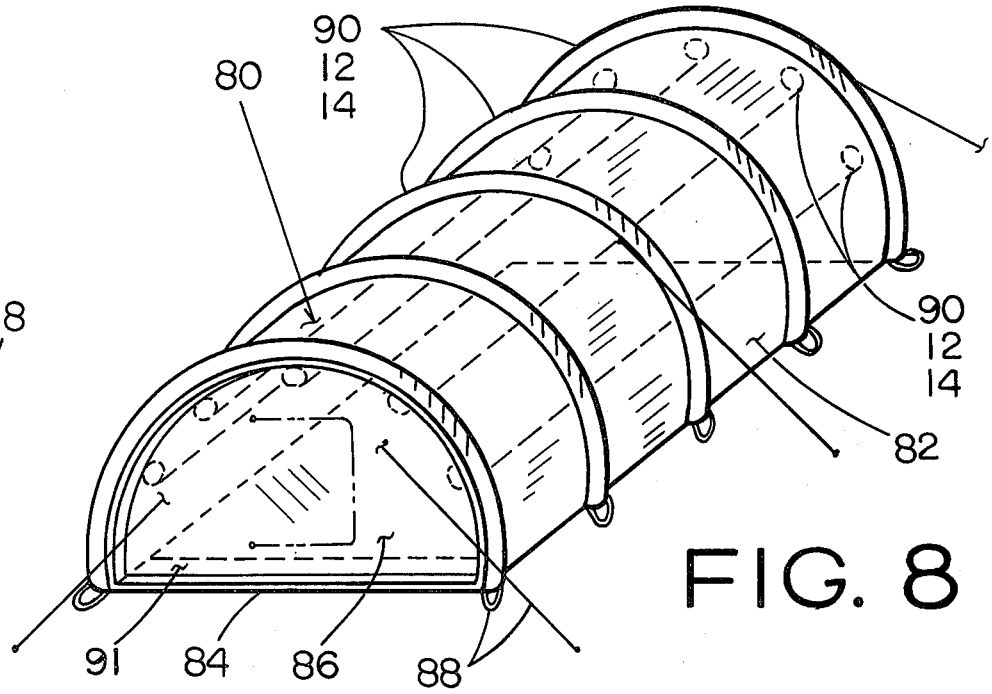
FIG. 8 is an oblique view of a tape strut tent using tape struts to withstand load.

In FIG. 8, there is a tent 80 having a canopy 82, a floor 84, a side wall 86 at each end, a plurality of cords 88, a plurality of reinforcing strips 90 together with zipper 12 stitched around the contour of the canopy 82, and a plurality of reinforcing strips 91 on the floor 84. The tent 80 has doors, windows, nettings and etc. as the commonly used tents.

To erect the tent, pull out tape 14 in tape assembly 40, attach snap fastener 21 or 22 on tape 14 onto the snap fastener 22 or 21 on zipper 12 on strip 90. Put puller 20 at zipper 12 of strip 90 onto hook 74 at tape assembly 40. Move tape assembly 40 along to close zipper 12 on strip 90. Go on to other strips 90 until all of them have tape 14 enclosed. Thus, the tent 80 will be able to stand itself.

The tent 80 can be of any required shape with straight or curved tape strut 10 or tape 14 installed at either side of canopy 82 as necessary. It is feasible to use cord or sleeve or snap fastener to attach tape strut 10 onto canopy 82, if required.

By adding an electric wire, a lamp and a set of battery or the like to a tape strut, it is practical to use a Tape Strut Light to signal, at a visible elevation, the other person in camping area; or to warn, at a safe distance, a coming car at high speed in case a car is stopped on a highway due to any reason; or to illuminate a room as a decorating lamp.

By adding an open netting bag and a hook to a tape strut, it is practical to use a Tape Strut Post to pick fruit or sample or the like at a hard-to-reach location.

By adding a set of rigid members or the like to a tape strut, it is practical to use a Tape Strut Umbrella having spiral type or radial type of tape strut to facilitate its storage.

By adding a set of rigid frames and a hundred percent water proof flexible container to tape struts, it is practical to use a Tape Strut Container as a compact boat or a water pail.

By adding a spinning reel and related accessories to a tape strut, it is practical to use a Tape Strut Rod for fishing purpose.

By adding three-way panhead and related accessories to tape struts, it is practical to use a Tape Strut Tripod to support a camera to take picture.

The specifications of those of the previously mentioned tape strut light, tape strut post, tape strut umbrella, tape strut container, tape strut rod and tape strut tripod will be submitted in separate applications for patents.

The descriptions and illustrations mentioned above are those of the most preferred embodiments of this invention and no unnecessary limitations should be understood therefrom as modification will be obvious to those skilled in the art.

I claim:

1. A tape strut comprising at least a tape and at least a zipper, means of combination of said tape and said zipper, means of attaching of said tape onto said zipper while in use and means of storage of said tape and said zipper while not in use, said zipper forming a closed loop around said tape in cross section while in use so that said tape strut being able to be used to take load as a structure tubing.

2. A tape strut as in claim 1, wherein said means of combination has only one said tape and one said zipper.

3. A tape strut as in claim 1, wherein said means of combination has two said tapes of different width and a said zipper.

4. A tape strut as in claim 1, wherein said means of combination has three said tapes and a said zipper.

5. A tape strut as in claim 1, wherein said means of combination has five said tapes and a said zipper, one of said tapes being the diagonal of a shape in cross section.

6. A tape strut as in claim 1, wherein said means of combination has a plurality of said tapes of lamination in cross section while in use and a said zipper.

7. A tape strut as in claim 1, wherein said means of combination has a plurality of said tapes of lamination in cross section while in use and while not in use, and a said zipper.

8. A tape strut as in claim 1, wherein said means of combination has a plurality of said tapes and said zippers in end-to-end connection.

9. A tape strut as in claim 1, wherein said means of attaching is by the use of snap fasteners having a female snap fastener on one end of each of said tapes and a male snap fastener on the other end; and a male snap fastener on one end of each of said zipper and a female snap fastener on the other end, so that said tapes and said zippers being able to be separated while not in use in case required.

10. A tape strut as in claim 1, wherein said means of attaching is by the use of glue between said tape and said zipper.

11. A tape strut as in claim 1, wherein said means of attaching is by the use of glue between said tapes and said zipper, said tapes having gap between each other to make folding of said tapes possible.

12. A tape strut as in claim 1, wherein said means of attaching is by the use of glue between said tapes and said zipper, said tapes having gap between each other to make folding of said tapes possible, and by the adding of a sub-strip on said zipper, said sub-strip being attached by a portion of said tapes.

13. A tape strut as in claim 1, wherein said means of storage is a casing, said casing having a lower half, a roller, an upper half and a plurality of screws, said lower half having a disk with a vertical wall on the outer ring, an axle tube at the middle, a tube half of varying depth, width and radius, a plurality of slots on said disk of said lower half and a plurality of threaded holes; said roller having a rotatable collar freely mounted on said axle tube, a disk having a vertical outer ring and a horizontal guard, a plurality of holes to facilitate the rotation of said roller, and a snap fastener to retain one end of said tape; said upper half having a horizontal disk with a vertical wall, a tube half of the image of said tube half on said lower half, a hole at the middle, said hole and said disk on said upper half being used to confine the rotation of said vertical outer ring and said horizontal guard on said roller, a plurality of holes corresponding to said threaded holes on said lower half, a hook to retain the puller on said zipper to close the fasteners on said zipper, a guide to combine with said tube halves on said lower half and said upper half to convert said tape into required shape in cross section through an inside opening and a hole, and an opening on said vertical walls of said lower and upper halves to allow a direct winding back of said tape.

14. A tape strut as in claim 1, wherein said means of storage is a roller having two disks connected by a collar at the center, said collar having a snap fastener to retain one end of said tape.

15. A tape strut as in claim 1, wherein said means of storage is by the use of the spring effect of said tape itself to wind back said tape in a coil roll.

16. A tape strut tent comprising a tent, at least a tape strut as in claim 1 and means of attaching of said tape strut onto said tent.

17. A tape strut tent as in claim 16, wherein said means of attaching is by stitching a plurality of said zippers onto the canopy of said tent as a provision to install said tapes of said tape struts.

18. A tape strut tent as in claim 16, wherein said means of attaching is by stitching a plurality of additional zippers onto the canopy of said tent as a provision to install said tape struts.

19. A tape strut tent as in claim 16, wherein said means of attaching is by stitching a plurality of sleeves onto the canopy of said tent as a provision to install said tape struts.

20. A tape strut tent as in claim 16, wherein said means of attaching is by stitching a plurality of cords onto the canopy of said tent as a provision to install said tape struts.

21. A tape strut tent as in claim 16, wherein said means of attaching is by adding a plurality of snap fasteners onto the canopy of said tent and onto said tape struts as provisions to install said tape struts.

* * * * *